United States Patent [19]

Belvederi

[11] Patent Number: 4,914,997

[45] Date of Patent: Apr. 10, 1990

[54] TRANSVERSE CUTTING DEVICE FOR CUTTING INTO LENGTHS A STRIP TRAVELING CONTINUOUSLY ALONG A PREDETERMINED PATH

[75] Inventor: Bruno Belvederi, S. Martino Di Monte S. Pietro, Italy

[73] Assignee: G.D. Societá Per Azioni, Bologna, Italy

[21] Appl. No.: 221,889

[22] Filed: Jul. 20, 1988

[30] Foreign Application Priority Data

Jul. 22, 1987 [IT] Italy ..... 3564 A/87

[51] Int. Cl.[4] ..... B26D 1/58

[52] U.S. Cl. ..... 83/156; 83/100; 83/327; 83/329; 83/345; 83/595; 83/596; 83/647.5

[58] Field of Search ..... 83/329, 327, 321, 646, 83/647.5, 594, 595, 596, 345, 299, 156, 100

[56] References Cited

U.S. PATENT DOCUMENTS

| | | | |
|---|---|---|---|
| Re. 30,598 | 5/1981 | Spencer | 83/327 X |
| 2,605,840 | 8/1952 | Parker | 83/329 |
| 3,552,251 | 1/1971 | Neff | 83/299 |
| 3,807,261 | 4/1974 | Couvreur | 83/326 X |
| 3,943,805 | 3/1976 | Lubitzsch | 83/329 X |
| 4,063,494 | 12/1977 | Hall | 83/329 X |
| 4,334,449 | 6/1982 | Hinz et al. | 83/345 X |
| 4,584,917 | 4/1986 | Blom | 83/174 |

*Primary Examiner*—Frank T. Yost
*Assistant Examiner*—Rinaldi Rada
*Attorney, Agent, or Firm*—Marshall, O'Toole, Gerstein, Murray & Bicknell

[57] ABSTRACT

A transverse cutting device for cutting into lengths a strip traveling continuously along a predetermined path, which device presents a drum for feeding and guiding the strip through a cutting station; and a cutting unit for successively cutting the strip transversely; at least one cutting element on the cutting unit being moved along an annular path lying in a plane intersecting the path of the strip in the cutting station, and along a given line forming an adjustable angle with a transversal intersecting the path of the strip; and the roller presenting peripheral grooves for longitudinally stretching the strip in the cutting station.

6 Claims, 3 Drawing Sheets

TRANSVERSE CUTTING DEVICE FOR CUTTING INTO LENGTHS A STRIP TRAVELING CONTINUOUSLY ALONG A PREDETERMINED PATH

BACKGROUND OF THE INVENTION

The present invention relates to a device for transversely cutting a strip into lengths.

A strip traveling continuously along a predetermined path is usually cut into lengths by feeding the strips through a cutting device comprising two rollers, one fitted with a blade and the other with a cutting surface or anvil, and by turning the said rollers in opposite directions so that the blade cooperates at regular intervals with the said cutting surface or anvil, thus cutting the strip.

A major drawback of known cutting devices of the afore-mentioned type is that they are relatively noisy, by virtue of the blade striking the cutting surface or anvil each time the strip is cut. Furthermore, such impact between the blade and anvil results in rapid wear of the blade, which therefore requires frequent grinding.

SUMMARY OF THE INVENTION

The aim of the present invention is to provide a device for cutting continuously-moving strips, designed to overcome the aforementioned drawbacks.

With this aim in view, according to the present invention, there is provided a transverse cutting device for cutting into lengths a strip traveling continuously along a predetermined path, said device comprising means for feeding and guiding the said strip along the said path and through a cutting station; and a cutting unit for successively cutting the said strip transversely; characterised by the fact that the said cutting unit comprises at least a cutting element; supporting and actuating means for moving the said cutting element along an annular path intersecting the said path of the said strip in the said cutting station, and along a given cutting line forming a given angle with a transversal intersecting the said path of the said strip; and means for adjusting the position of the plane of the said annular path in such a manner that, for a given speed of the said strip along the said path, the said angle depends on the size of the said lengths and the traveling speed of the said cutting element along the said cutting line; the said feeding and guide means comprising means for longitudinally stretching the said strip in the said cutting station.

BRIEF DESCRIPTION OF THE DRAWINGS

A number of non-limiting embodiments of the present invention will be described with reference to the accompanying drawings, in which.

DETAILED DESCRIPTION OF THE INVENTION

Figure 1:
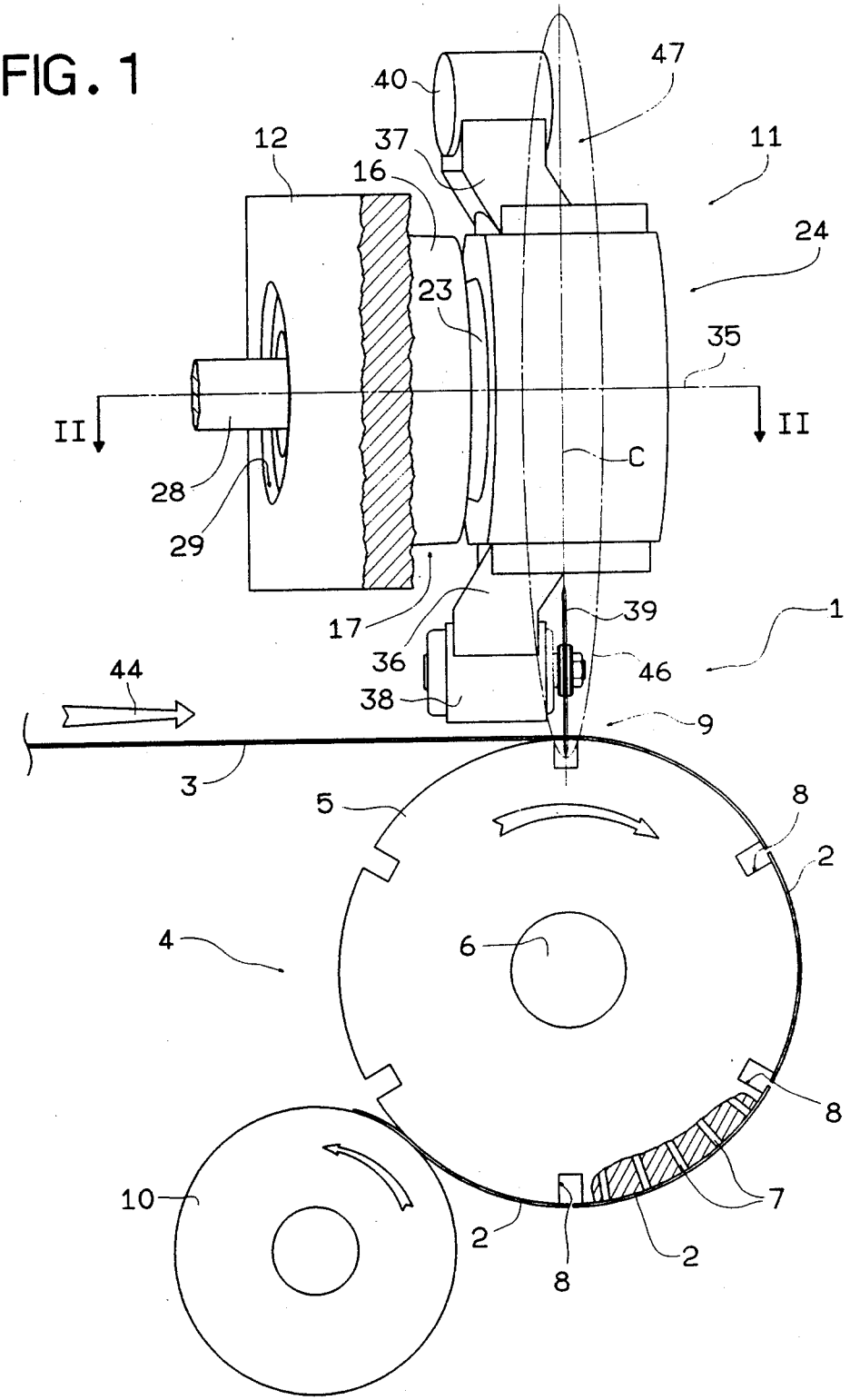
FIG. 1 shows a side view of a first embodiment of the cutting device according to the present invention.
Figure 2:
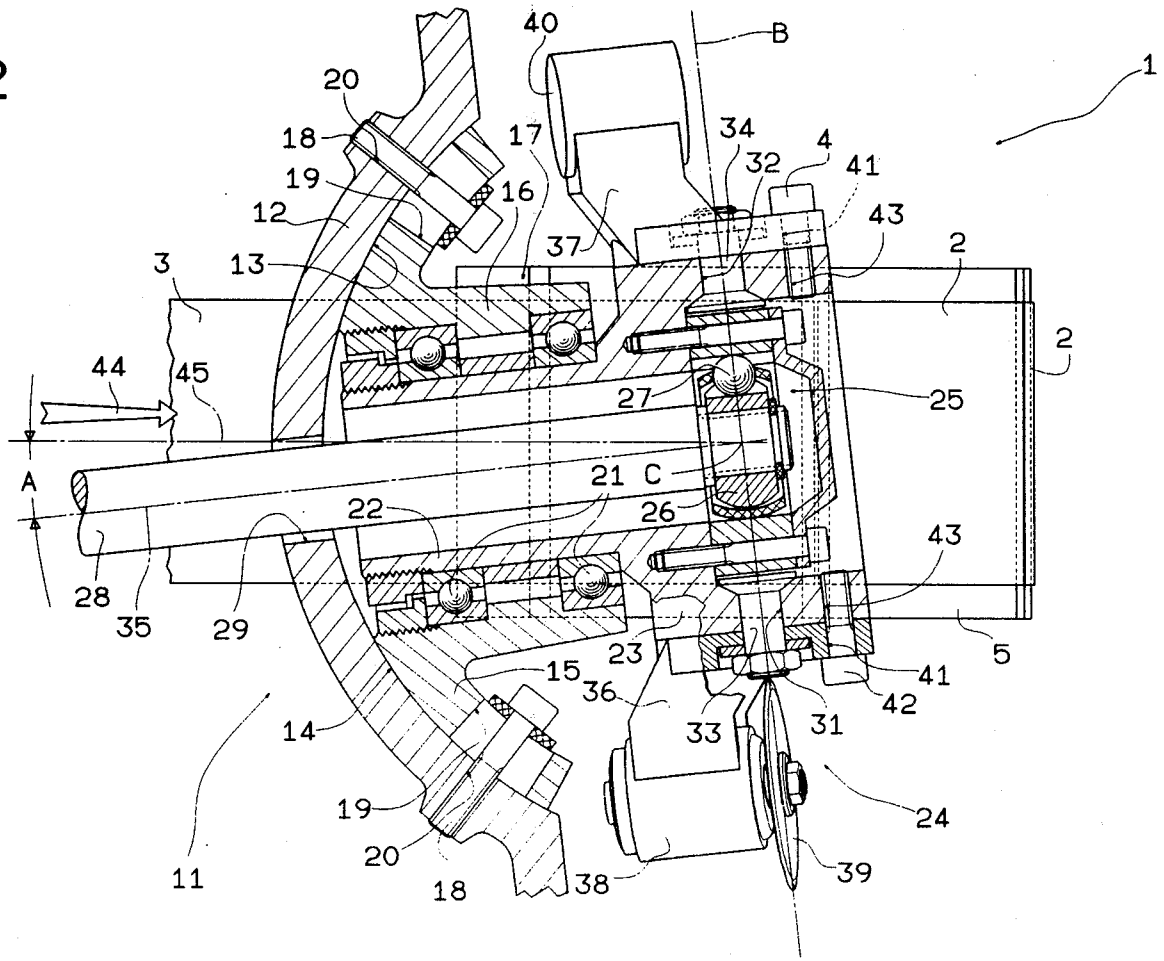
FIG. 2 shows a vertical section of a portion of the FIG. 1 device.

Number 1 in FIGS. 1 and 2 indicates a cutting device for cutting into lengths 2 a strip 3 fed continuously by a device 4 comprising a roller 5 turned by actuating means (not shown) about the axis of shaft 6. For feeding the said strip 3, the outer edge of roller 5 presents a number of radial openings 7 communicating in known manner (not shown) with a known suction system (not shown). Roller 5 also presents a number of peripheral grooves 8 parallel with its axis and equally spaced about roller 5 at intervals equal to the required size of lengths 2.

Roller 5 is designed to feed strip 3 through a cutting station 9 where the said strip 3 is cut into lengths 2, which are fed successively off roller 5 on to an output roller 10 tangent to roller 5 and also fitted in known manner with suction means (not shown).

Cutting device 1 comprises a cutting unit 11 in turn comprising a guide consisting of a plate 12 located over the path of strip 3 and having a concave outer surface 13 consisting of a cylindrical surface portion, the axis C of which is substantially perpendicular to the plane of strip 3 upstream from roller 5.

The said surface 13 mates in sliding manner with a convex surface 14 constituting the outer surface of a cylindrical plate 15. A tubular body 16 extends radially from the center line of the concave inner surface of plate 15, which body 16 is integral with plate 15 and constitutes with the same a slide 17 designed to slide over surface 13. The said slide 17 is locked on to plate 12 by means of an adjusting device comprising a pair of screws 18, the shanks of which engage in sliding manner respective slots 19 formed through plate 15 and parallel with the plane of underlying strip 3, and the threaded ends of which engage respective threaded holes 20 formed through plate 12.

Two grooves are formed inside tubular body 16, each housing the outer ring of a respective radial bearing 21 supporting a coupling 22 mounted in rotary manner inside tubular body 16 and having, outside the free end of tubular body 16, an end portion 23 forming part of a cutting head indicated as a whole by 24.

Portion 23 of coupling 22 is fitted with the internally-grooved outer ring of a constant-velocity universal joint 25 intersected by axis C and housed substantially barycentrically inside head 24. Portion 23 is connected angularly to an inner portion 26 of joint 25 via balls 27. Joint 25 is fitted on to the end of a powered drive shaft 28 extending inside coupling 22 and through hole 29 on plate 12.

As shown, particularly in FIG. 2, portion 23 of coupling 22 presents two diametrically-opposed radial holes 31 and 32 engaged by respective coaxial pins 33 and 34, the axis B of which passes through the center point of joint 25 defined by the intersection of axis C and axis 35 of cutting head 24.

Cutting head 24 also comprises a pair of substantially L-shaped appendixes 36 and 37 connected in rotary manner to pins 33 and 34 respectively. The free end of appendix 36 supports a motor 38 powering a cutting element consisting of a cutting disc 39 having its axis of rotation perpendicular to axis B, and lying in a plane through the same. As shown in FIG. 1, blade 39 is located at such a distance from axis 35 as to turn about the same and interfere with the portions of strip 3 stretched successively across grooves 8, without engaging roller 5. Appendix 37 is fitted with a counterweight 40 for balancing motor 38 and blade 39 about axis 35, without interfering with strip 3.

Each of appendixes 36 and 37 presents a circular slot 41 extending about axis B and engaged by a screw 42, one end of which is engaged inside a threaded radial hole 43 formed through portion 23 and parallel with holes 31. The said screws 42 provide for adjusting the plane of blade 39 about axis B and, consequently also, the position of counterweight 40.

In actual use, strip 3 is fed by device 4 in the direction of arrow 44, and along a surface (horizontal in the example shown). As far as roller 5, the said strip 3 traveling at constant speed along a path, the mid line 45 of which (FIG. 2) preferalby intersects axis C.

The rotation speed of head 24 and roller 5 is regulated so that each forward rotation of roller 5 equivalent to the distance between two adjacent grooves 8 is accompanied by a complete turn of head 24 about axis 35.

When the said head 24 is turned about axis 35, blade 39 moves along an annular path (46 in FIG. 1) the plane 47 of which is adjustable about axis C by means of screws 18. That is to say, by loosening screws 18, slide 17 may be turned in relation to guide 12 so that axis 35 of cutting head 24 and line 45, and therefore plane 47 and a transversal intersecting strip 3, form a given angle A as shown in FIG. 2 and according to the following equation:

$$H = Z \text{ tang } A$$

wherein H is the length of groove 8, and the Z the distance covered by strip 3 in the time taken by blade 39 to travel along groove 8.

Finally, by loosening and subsequently locking screws 42, the plane of blade 39 may be adjusted in such a manner that the said blade 39 engages groove 8 substantially perpendicularly to strip 3. Generally speaking, however, such a condition is only achieved accurately when blade 39 passes through axis C.

By virtue of the above adjustments, blade 39, turning about its own axis as well as axis 35, engages a groove 8 at each turn about axis 35, thus cutting strip 3 successively into lengths 2. At each cutting operation, the point of contact between blade 39 and strip 3 moves tranversely in relation to strip 3, but obliquely in space, by virtue of the said point of contact moving transversely in relation to strip 3 and also axially with the same, in the direction of arrow 44, along an oblique cutting line forming an angle equal to angle A with a transversal intersecting the traveling direction of strip 3.

As the cut portions of strip 3 are those stretched between the opposite edges of respective grooves 8, strip 3 is cut into lengths 2 with no need for a cutting surface or anvil, thus eliminating the operating noise associated with the same. Furthermore, by virtue of strip 3 being cut along portions of the same which span or bridge grooves 8, wear on blade 39 is practically negligible, thus drastically reducing grinding of the same. Since the strip 3 spans grooves 8, it is inherently stretched over the grooves at the cutting station.

Figure 3:
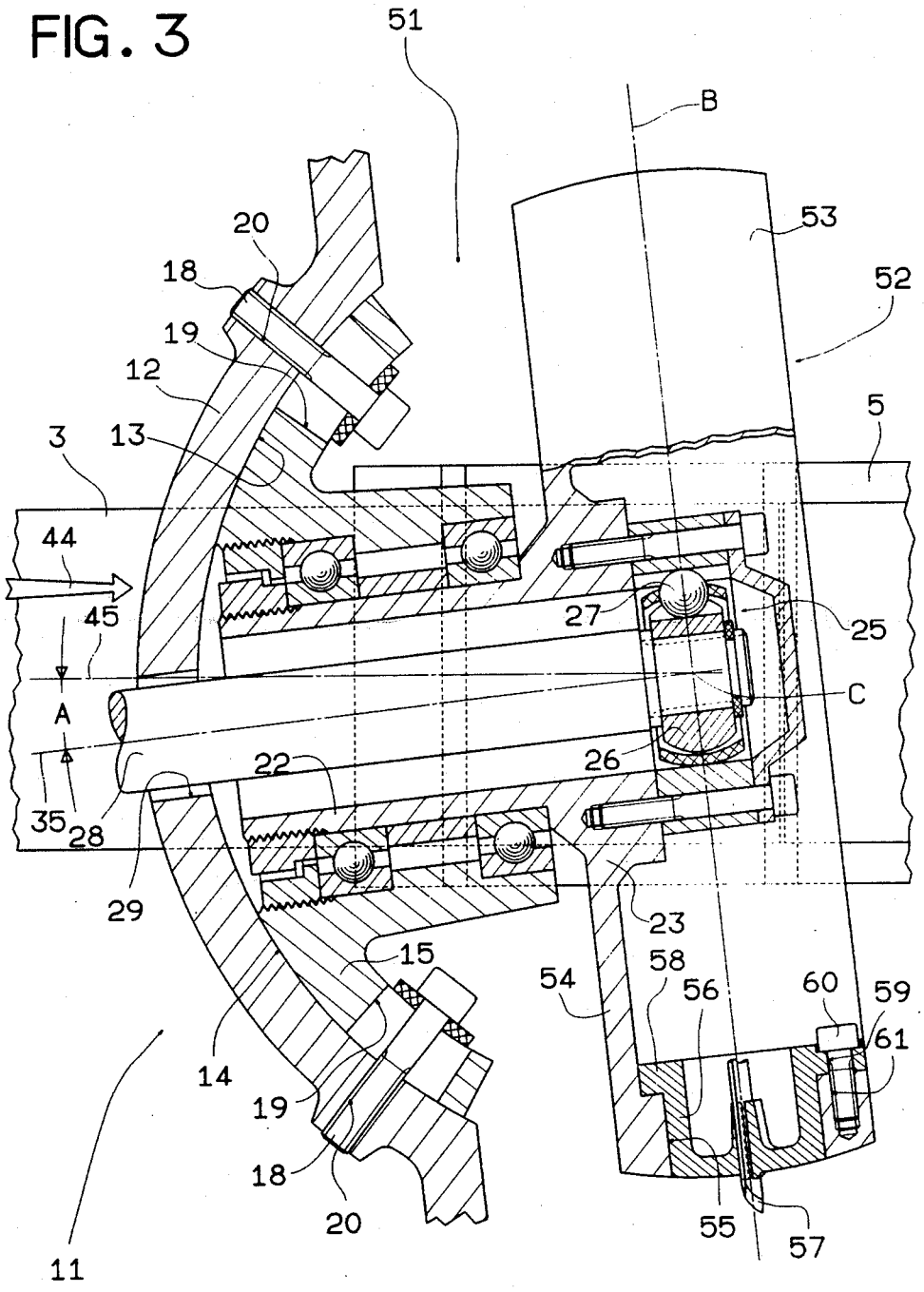
FIG. 3 shows a section, similar to that of FIG. 2, of a second embodiment of the cutting device according to the present invention.

The FIG. 3 embodiment relates to a cutting device 51, which differs from device 1 solely by comprising a cutting head 52 defined by a substantially cylindrical, hollow drum 53 connected integral with the end of portion 23 of coupling 22 by means of an annular flange 54. Drum 53 is turned about shaft 28 by joint 25, and presents a circular radial hole 55 inside which is fitted in rotary manner a cylindrical body 56, the axis of rotation of which coincides with axis B. Cylindrical body 56 supports a cutting element consisting of a sickle type blade 57 extending radially outwards of drum 53, and the axis of which coincides with axis B. Body 56 presents an inner flange 58 cooperating with an inner surface of drum 53, and having a circular slot 59 coaxial with axis B. Slot 59 is engaged by a screw 60 fitted in a threaded radial hole 61 formed on drum 53, and designed to enable adjustment of the blade 57 plane about axis B.

Adjustment and operation of head 52 are as already described in connection with head 24.

The attached drawings show the axis of head 24 and 52 coinciding with that of drive shaft 28, which condition does not apply, of course, subsequent to the adjustments described above and permitted by virtue of the said joint 25.

Both heads 24 and 52 may, of course, be fitted with two or more equally-spaced cutting elements (not shown).

I claim:

1. A transverse cutting device (1,51) for cutting into lengths (2) of a predetermined size a strip (3) traveling continuously along a predetermined first path, said device comprising means (4) for feeding and guiding said strip (3) along said first path and through a cutting station (9); and a cutting unit (11) for successively cutting said strip (3) transversely; said cutting unit (11) comprising at least one cutting element (39,57); supporting and actuating means (12,17,24,52) for moving said cutting element (39,57) along an endless second path (46) laying on a plane extending substantially transversely to said first path, and intersecting said first path in said cutting station (9), and along a given cutting line, the first path having a line (45) forming a given angle (A) with a line perpendicular to said cutting line; a means (18,19) for adjusting the position of the plane of said second path in such a manner that, for a given speed of said strip (3) along said first path, said angle (A) depends on the size of said lengths (2) and traveling speed of said cutting element (39,57) along said cutting line; said feeding and guide means (4) comprising a roller (5) turning about an axis perpendicular to said first path, and at least one longitudinal groove formed alng a peripheral surface of said roller (5); said cutting element (39,57) moving, in use, along said groove (8) as said groove (8) is advanced by said roller (5) through said cutting station (9).

2. A device as claimed in claim 1 wherein said supporting and actuating means (12,17,24,52) comprises a curved guide (12) extending about a first axis (C) perpendicular to said first path; a slide (17) mounted so as to slide along said guide (12); a rotary cutting head (24,52) mounted on said slide (17) for rotation in relation thereto about a second axis (35) perpendicular to said first axis (C); and drive means for turning said head about said second axis; said drive means comprising a drive shaft (28) and a joint (25) located between said shaft (28) and said head (24,52); said joint (25) being centered on said first axis (C).

3. A device as claimed in claim 2 wherein said joint (25) is a constant-velocity universal joint located substantially barycentrically inside said head (24,52); said shaft (28) extending through said guide (12) and said slide (17); and said adjusting means (18,19) comprising means (18) for releasably locking said slide (17) in relation to said guide (12) so that a line perpendicular to said cutting line and said first path line (45) form said given angle (A).

4. A device as claimed in claim 3 wherein said cutting element (39,57) is connected to said cutting head (24,52) for movement in relation thereto about a third axis (B); said first (C) and second (35) axes intersecting each other at a point; said third axis (B) extending through said intersection point; and further adjusting means (41,42) (59,60) being provided to set said cutting element in position about said third axis (B) and in relation to said cutting head.

5. A device as claimed in claim 4 wherein said cutting element comprises a blade (57) extending substantially radially from said head (52), and laying on a plane which is adjustable in position via said further adjusting means (59,60).

6. A device as claimed in claim 5 wherein said cutting element comprises a rotary circular blade (39) located substantially radially on said head (24), and laying on a plane which is adjustable in position via said further adjusting means; actuating means (38) being provided for rotating said circular blade about its own axis and in relation to said head (24).

* * * * *